United States Patent [19]

Honda et al.

[11] Patent Number: 4,540,645

[45] Date of Patent: Sep. 10, 1985

[54] MAGNETIC BRUSH DEVELOPMENT METHOD

[75] Inventors: Nobuyasu Honda, Tenri; Toshikazu Matsui, Kishiwada; Akira Fushida, Suita; Toshimitsu Ikeda, Himeji; Kenji Takahashi, Hirakata; Hideo Fukuda, Katano; Yasushi Kamezaki, Sakai; Takashi Teshima, Yokohama, all of Japan

[73] Assignee: Mita Industrial Co Ltd, Osaka, Japan

[21] Appl. No.: 574,575

[22] Filed: Jan. 27, 1984

[30] Foreign Application Priority Data

Jan. 31, 1983 [JP] Japan ..... 58-12971
Mar. 23, 1983 [JP] Japan ..... 58-47266

[51] Int. Cl.[3] ..... G03G 13/09; G03G 15/09

[52] U.S. Cl. ..... 430/122; 430/106.6; 118/658

[58] Field of Search ..... 430/122; 118/657, 658

[56] References Cited

U.S. PATENT DOCUMENTS 4,086,873 5/1978 Morita et al. ..... 118/658
4,254,202 3/1981 Matsumoto et al. ..... 118/658 X
4,286,543 9/1981 Ohnuma et al. .
4,324,199 4/1982 Morikawa ..... 118/658
4,401,740 8/1983 Kawabata et al. ..... 430/122 X
4,444,864 4/1984 Takahashi ..... 118/658 X

FOREIGN PATENT DOCUMENTS 52-67633 6/1977 Japan ..... 118/657

*Primary Examiner*—Roland E. Martin
*Attorney, Agent, or Firm*—Sherman & Shalloway

[57] ABSTRACT

Disclosed is a magnetic brush development method comprising supplying a two-component type developer comprising a mixture of magnetic carrier particles with toner particles chargeable by friction with the magnetic carrier particles onto a developing sleeve consisting of a non-magnetic sleeve having a magnet installed therein to form a magnetic brush of the developer, and bringing the magnetic brush in sliding contact with the surface of a photosensitive material having an electrostatic latent image formed thereon in the state where a bias voltage is applied between the photosensitive material and the sleeve, whereby a toner image corresponding to the electrostatic latent image is formed, wherein the two-component type developer comprises a ferrite carrier and electroscopic toner particles at a weight ratio of from 4/1 to 20/1.

11 Claims, 4 Drawing Figures

MAGNETIC BRUSH DEVELOPMENT METHOD

BACKGROUND OF THE INVENTION (1) Field of the Invention

The present invention relates to a magnetic brush development method. More particularly, the present invention relates to a magnetic brush development method for forming a toner image excellent in the image characteristics by using a two-component type developer comprising a ferrite carrier and electroscopic toner particles.

(2) Description of the Prior Art

In the electrophotographic process using a two-component type magnetic developer, an electroscopic toner is mixed with a magnetic carrier, this two-component type composition is supplied onto a developing sleeve having a magnet installed therein to form a magnetic brush consisting of this composition, and this magnetic brush is brought into sliding contact with an electrophotographic photosensitive plate having an electrostatic latent image formed thereon, whereby an electroscopic toner image is formed on the photosensitive plate. The electroscopic toner is charged with a polarity reverse to that of the polarity of the charge of the electrostatic latent image on the photosensitive plate by the friction with the magnetic carrier, the electroscopic toner particles on the magnetic brush are attracted onto the electrostatic latent image by the Coulomb force to effect the development of the electrostatic latent image. On the other hand, the magnetic carrier is attracted by the magnet in the sleeve, and since the charge polarity of the magnetic carrier is the same as that of the electrostatic latent image, the magnetic carrier is left on the sleeve. In order to form a clear image having a high density, it is important that a sufficient difference of the relative speed should be produced between the photosensitive plate and the magnetic brush so as to bring about sufficient sliding contact between the photosensitive plate and the magnetic brush.

An iron powder carrier is ordinarily used as the magnetic carrier. However, this iron powder carrier is still insufficient in various points. For example, a two-component type developer comprising this iron powder carrier is defective in that the rising of the development sensitivity curve (the curve showing the relation of the difference of the voltage between the electrostatic latent image and the developing sleeve to the image density) is sharp, and the gradation characteristic is poor and the reproducibility of a halftone is insufficient. Furthermore, a developer comprising this iron powder carrier often forms a hard magnetic brush and involves a risk of impairing the photosensitive layer, and at the reproduction of a solid black portion, brush marks, that is, many fine and short white lines extending in the sliding direction of the brush, are formed on the resulting image. Moreover, the iron powder carrier is sensitive to the humidity and the development characteristics are changed according to the humidity, or rusting is caused in the iron powder carrier. Still further, this iron powder carrier is defective in that a large torque is necessary for driving the magnetic brush.

Use of ferrite, especially soft ferrite, as the magnetic carrier of a two-component type developer has recently been proposed. However, since the ferrite carrier has an electric resistance higher than that of the iron powder carrier, such troubles as carrier drawing, that is, migration of the carrier to the photosensitive layer, and occurrence of edge effects in the formed image are readily caused.

In the magnetic brush development using a ferrite carrier, phenomena not observed in the development using an iron powder carrier are thus caused to occur. However, the conditions for this magnetic brush developing have not been sufficiently elucidated.

SUMMARY OF THE INVENTION

It is therefore a primary object of the present invention to provide a magnetic brush development method using a ferrite carrier, in which the above-mentioned defects are eliminated.

Another object of the present invention is to provide a magnetic brush development method using a ferrite carrier, in which a toner image having a high density and a good gradation characteristic is formed without defects such as formation of brush marks, carrier drawing and transposition due to edge effect.

More specifically, in accordance with the present invention, there is provided a magnetic brush development method comprising supplying a two-component type developer comprising a mixture of magnetic carrier particles with toner particles chargeable by friction with the magnetic carrier particles onto a developing sleeve consisting of a non-magnetic sleeve having a magnet installed therein to form a magnetic brush of the developer, and bringing the magnetic brush in sliding contact with the surface of a photosensitive material having an electrostatic latent image formed thereon in the state where a bias voltage is applied between the photosensitive material and the sleeve, whereby a toner image corresponding to the electrostatic latent image is formed, wherein the two-component type developer comprises a ferrite carrier and electroscopic toner particles at a weight ratio of from 4/1 to 20/1.

In accordance with one preferred embodiment of the present invention, there is provided a magnetic brush development method as described above, wherein the development is carried out under conditions satisfying requirements represented by the following formulae:

$$5\times10^{9}\geqq R\geqq 1\times10^{8},$$

$$d\leqq(1.485\times10^{5})/(\log R)^{5.3}$$

and $$d\geqq(1.485\times10^{5})/(\log R)^{5.5}$$

wherein d stands for the clearance (mm) between the sleeve and the photosensitive material and R stands for the electric resistance (Ω) of the two-component type developer located between the sleeve and the photosensitive material.

In accordance with another preferred embodiment of the present invention, there is provided a magnetic brush development method as described above, wherein a non-magnetic sleeve is moved at the position for the sliding contact with the developer in the direction opposite to the moving direction of a drum and the magnet in the sleeve is kept stationary during the development, and the development is carried under conditions satisfying requirements represented by the following formulae:

$$2.4\geqq|v/V|\geqq 15,$$

$$|v/V|\geqq -0.12\theta+1.8$$

and $$\theta \leqq 5$$

wherein $\theta$ stands for the preset angle (degrees), in the downstream direction of rotation of the drum, of the magnetic pole closest to the standard line connecting the center of the drum to the center of the sleeve, V stands for the peripheral speed of the drum and v stands for the peripheral speed of the sleeve.

DETAILED DESCRIPTION OF THE PREFERRED EMBODIMENTS

Figure 1:
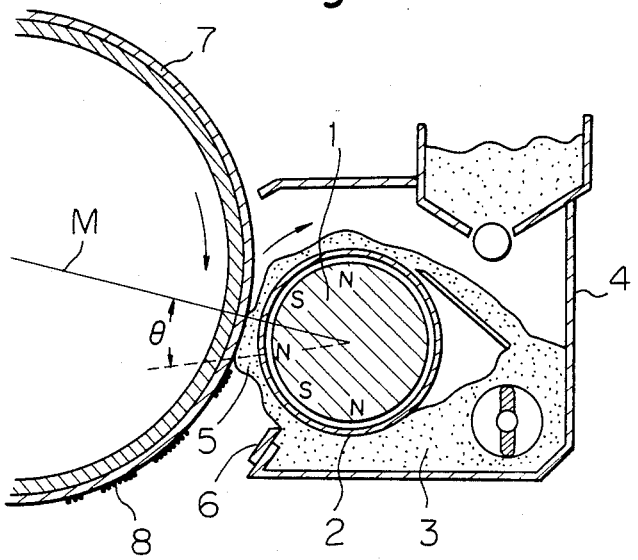
FIG. 1 is a diagram illustrating the principle of the magnetic brush development method.

Referring to FIG. 1 illustrating the magnetic brush development method, a magnet roll 1 provided with magnetic poles N and S is contained in a sleeve 2 formed of a non-magnetic material such as aluminum, and at least one of the magnetic roll 1 and sleeve 2 is driven and rotated. A two-component type developer 3 is supplied on the outer peripheral surface of the sleeve 2 from a developer tank 4 to form a magnetic brush 5. The ear length of the magnetic brush 5 is adjusted by an ear cutting mechanism 6, and the magnetic brush 5 is delivered to the position for the sliding contact with an electrophotographic photosensitive layer 7 and an electrostatic latent image on a drum substrate is developed with an electroscopic toner 8 to form a visible image.

The present invention is characterized in that a two-component type developer comprising a ferrite carrier and electroscopic toner particles at a weight ratio of from 4/1 to 20/1, especially from 5/1 to 12/1, is used for the development.

When the development is carried out by using this two-component type developer, since the ferrite carrier has a hardness lower than that of the iron powder carrier and it comprises particles having a substantially spherical shape, the magnetic brush of the developer formed on the sleeve is softer than the magnetic brush formed by using the iron powder carrier.

Accordingly, formation of brush marks in an image which is observed when the development is carried out by using the iron powder carrier can be effectively prevented by the use of the ferrite carrier even under such development conditions that the sliding contact of the magnetic brush with the photosensitive layer is uniformly performed in a broad region at high frequencies. Therefore, developing conditions improving the sliding contact efficiency and broadening the sliding contact region can be selected and images which have a high density and are free of defects can be formed.

Figure 2:
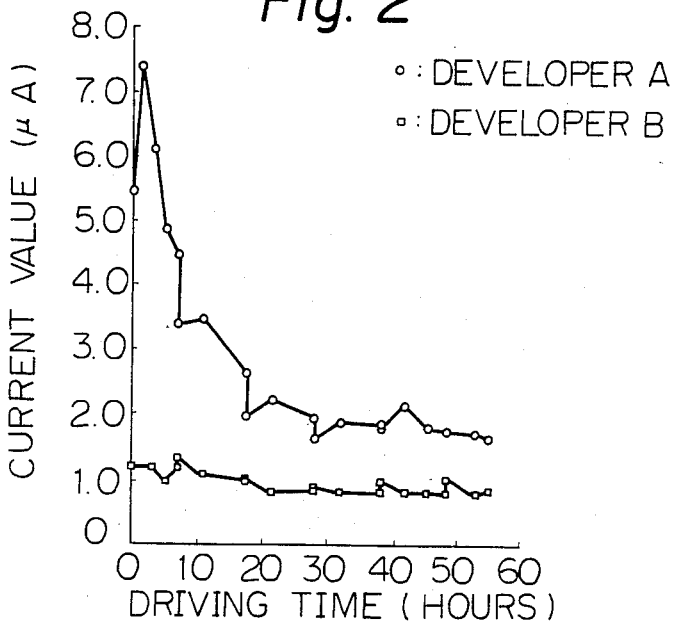
FIG. 2 is a diagram illustrating the change of the electric characteristics of a developer with the lapse of time.

FIG. 2 shows the relation between the current value ($\mu$A) measured according to the method described hereinafter with respect to a developer A comprising an iron powder carrier and an electroscopic toner at a weight ratio of 10/1 and a developer B comprising a ferrite carrier and the same electroscopic toner at a weight ratio of 10/1 and the driving time (hours) of a drum and a sleeve. From the results of this measurement, it is apparent that the developer comprising the ferrite carrier has an electric resistance much higher than that of the developer comprising the iron powder carrier, and that in case of the developer comprising the ferrite carrier, the electric resistance is kept substantially constant even if the operation is conducted for a long time while in case of the developer comprising the iron powder carrier, the electric resistance is considerably changed and extreme increase of the electric resistance is caused. The reason why the electric resistance is increased with the lapse of time in the developer comprising the iron powder carrier is considered to be that the toner particles are pulverized by the carrier to reduce the particle size of the toner and a filmy cover is formed on the carrier by the resin contained in the toner particles. The results shown in FIG. 2 indicate that in case of a developer comprising a ferrite carrier and an electroscopic toner, the electric characteristics are stable even if the operation is conducted for a long time and defects caused in a developer comprising an iron powder carrier, such as fine pulverization of toner particles and resin coating of the surface of the carrier are not caused.

Incidentally, the current value ($\mu$A) is determined by arranging an electrode drum having the same size as that of the photographic photosensitive material drum instead of the photosensitive material drum, supplying the developer onto the developing sleeve to form a magnetic brush, bringing the magnetic brush into sliding contact with the electrode drum, applying a voltage between the sleeve and the drum and measuring an electric current flowing between the drum and the sleeve.

Sintered ferrite particles, especially spherical sintered ferrite particles, are advantageously used as the ferrite carrier in the present invention. It is preferred that the particle size of the sintered ferrite particles be in the range of from 20 to 100 microns.

If the particle size of the sintered ferrite particles is smaller than 20 microns, it is difficult to maintain good earing of the magnetic brush, and if the particle size of the sintered ferrite particles is larger than 100 microns, brush marks, that is, scratches, are readily formed in the obtained toner image.

The sintered ferrite particles used in the present invention are known. For example, sintered ferrite particles comprising at least one member selected from zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) may be used. Sintered ferrite particles comprising manganese zinc iron oxide are especially suitable for attaining the objects of the present invention.

Any of coloring toners having both the electroscopic property and the fixing property can be used in the present invention. A granular composition comprising a coloring pigment and a charge controlling agent dispersed in a binder resin and having a particle size of 5 to 30 microns is preferably used in the present invention. A thermoplastic resin or an uncured or precondensed thermosetting resin is used as the binder resin. As the binder resin, there can be mentioned, in the order of importance, a vinyl aromatic resin such as polystyrene, an acrylic resin, a polyvinyl acetal resin, a polyester resin, an epoxy resin, a phenolic resin, a petroleum resin and an olefin resin. As the pigment, there may be used, for example, carbon black, cadmium yellow, molybdenum orange, Pyrazolone Red, Fast Violet B and Phthalocyanine Blue. These pigments may be used singly or in the form of a mixture of two or more of them. As the charge controlling agent, there may be used oil-soluble dyes such as Nigrosine Base (CI 50415), Oil Black (CI 26150) and Spiron Black, metal salts of naphthenic acid, metal soaps of fatty acids and soaps of resin acids.

In the present invention, it is important that the ferrite carrier and the electroscopic toner should be used at the above-mentioned weight ratio. If the amount of the ferrite carrier is too large, the image density tends to decrease and if the amount of the ferrite carrier is too small, fogging in the non-image area (coloration of the background) becomes conspicuous.

In order to improve the image density, it is preferred that the development be carried out under the following conditions. More specifically, in accordance with one preferred embodiment of the present invention, the above-mentioned developer is used for the development and the development is carried out under conditions satisfying requirements represented by the following formulae:

$$5\times10^9 \geqq R \geqq 1\times10^8 \quad (1),$$

$$d \leqq (1.485\times10^5)/(\log R)^{5.3} \quad (2)$$

and $$d \geqq (1.485\times10^5)/(\log R)^{5.5} \quad (3)$$

wherein d stands for the clearance (mm) between the sleeve and the photosensitive material and R stands for the electric resistance (Ω) of the two-component type developer located between the sleeve and the photosensitive material, namely the electric resistance calculated from the current value determined according to the above-mentioned measurement method.

Figure 3:
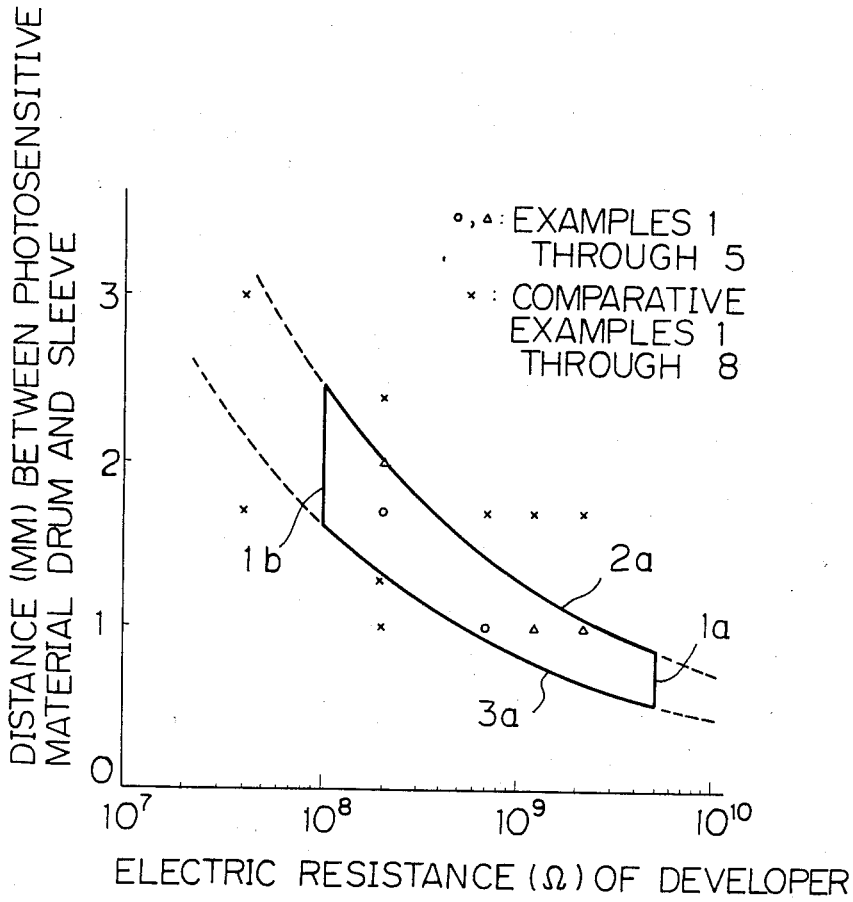
FIG. 3 is a diagram illustrating relations of the distance between a drum of a photosensitive material and a sleeve to the electric resistance of a developer, which are observed in Examples of the present invention and Comparative Examples.

The development conditions adopted in the above-mentioned preferred embodiment will now be described with reference to FIG. 3. The conditions adopted in this preferred embodiment are expressed as the region surrounded by four lines 1*a*, 1*b*, 2*a* and 3*a* in FIG. 3. Line 1*a* indicates the equation of $R=5\times10^9$, line 1*b* indicates the equation of $R=1\times10^8$, line 2*a* indicates the equation of $d=1.485\times10^5/(\log R)^{5.3}$, and line 3*a* indicates the equation of $d=1.485\times10^5/(\log R)^{5.5}$.

The electric resistance of a magnetic brush of a developer comprising a ferrite carrier and an electroscopic toner is relatively high, as pointed out hereinbefore. However, in the region on the right side of line 1*a*, transposition due to the so-called edge effect is caused in the solid colored portion or transposition is caused at the boundary portion of the halftone. In order to prevent occurrence of this undesirable phenomenon, it is preferred that the resistance of the magnetic brush be on the left side of line 1*a*, that is, the requirement of $R\leqq5\times10^9\Omega$ be satisfied.

In the region on the left side of line 1*b*, brush marks are readily formed in the obtained image. According to the present invention, formation of brush marks is effectively prevented by arranging the resistance of the magnetic brush on the right side of line 1*b*, that is, satisfying the requirement of $R\geqq1\times10^8\Omega$. Incidentally, brush marks are fine white lines extending in the sliding contact direction of the magnetic brush, which are formed during formation of the toner image. The cause of this undesirable phenomenon is considered to be that after the toner particles once adhere to the electrostatic latent image, leakage of charges is caused by the sliding contact with the magnetic brush and the toner particles are separated from the electrostatic latent image again. According to the present invention, by controlling the electric resistance of the magnetic brush within the above-mentioned range, formation of these brush marks can effectively be prevented.

In connection with the electric resistance (R) of the magnetic brush and the development clearance (d), in the region on the right and upper side of line 2*a*, the density of the formed image tends to decrease and the above-mentioned transposition is often caused. In the magnetic brush development, ordinarily, the larger is the quantity of the development electric current flowing through the magnetic brush, that is, the larger is the quantity of charges injected into the toner through the magnetic brush, the higher becomes the toner density. In the present invention, by carrying out the development in the region on the lower and left side of line 2*a*, the quantity of charges injected into the toner is increased and hence, the image density is prominently improved.

In the region on the lower and left side of line 3*a*, the gradation characteristic of the formed image is extremely poor and tailing or the like is caused in the formed image. According to the present invention, by carrying out the development in the region on the upper and right side of line 3*a*, the quantity of charges injected through the magnetic brush is controlled within an appropriate range and hence, a clear image having a proper gradation characteristic and being free of tailing can be obtained.

From the experimental showings given in Examples given hereinafter, it is apparent that if the development is carried out under conditions slightly deviated from the region surrounded by the four lines in FIG. 3, the image quality is drastically reduced. Accordingly, it will readily be understood that the development region surrounded by the four lines in FIG. 3 is very critical for obtaining an image having a high quality.

In this preferred embodiment of the present invention, the adjustment of the development clearance (d) can easily be accomplished by mechanically adjusting the relative positions of the photosensitive drum and developing sleeve.

The electric resistance of the magnetic brush of the two-component type developer can be adjusted by various means. For example, ferrite and toner particles having constant electric resistances should be selected. If the amount of the toner particles is increased or the size of the toner particles is reduced, the electric resistance of the magnetic brush is increased. Furthermore, if the size of the ferrite carrier is increased, the electric resistance of the magnetic brush is increased. Of course, inverse results are obtained by contrary means.

In accordance with another preferred embodiment of the present invention, the non-magnetic sleeve 2 is moved in the direction opposite to the moving direction of the drum 7 at the position for the sliding contact with the magnetic brush of the developer and the magnet 1 within the sleeve is kept stationary during the development, and the development is carried out under conditions satisfying requirements represented by the following formulae:

$$2.4 \geqq |v/V| \geqq 1.5 \quad (1),$$

$$|v/V| \geqq -0.12\theta + 1.8 \quad (2)$$

and $$\theta \leqq 5 \quad (3)$$

where $\theta$ stands for the preset angle (degrees), in the downstream direction of rotation of the drum, of the magnetic pole N or S closest to the standard line M connecting the center of the drum 7 to the center of the sleeve 2, V stands for the peripheral speed of the drum 7 and v stands for the peripheral speed of the sleeve 2.

Figure 4:
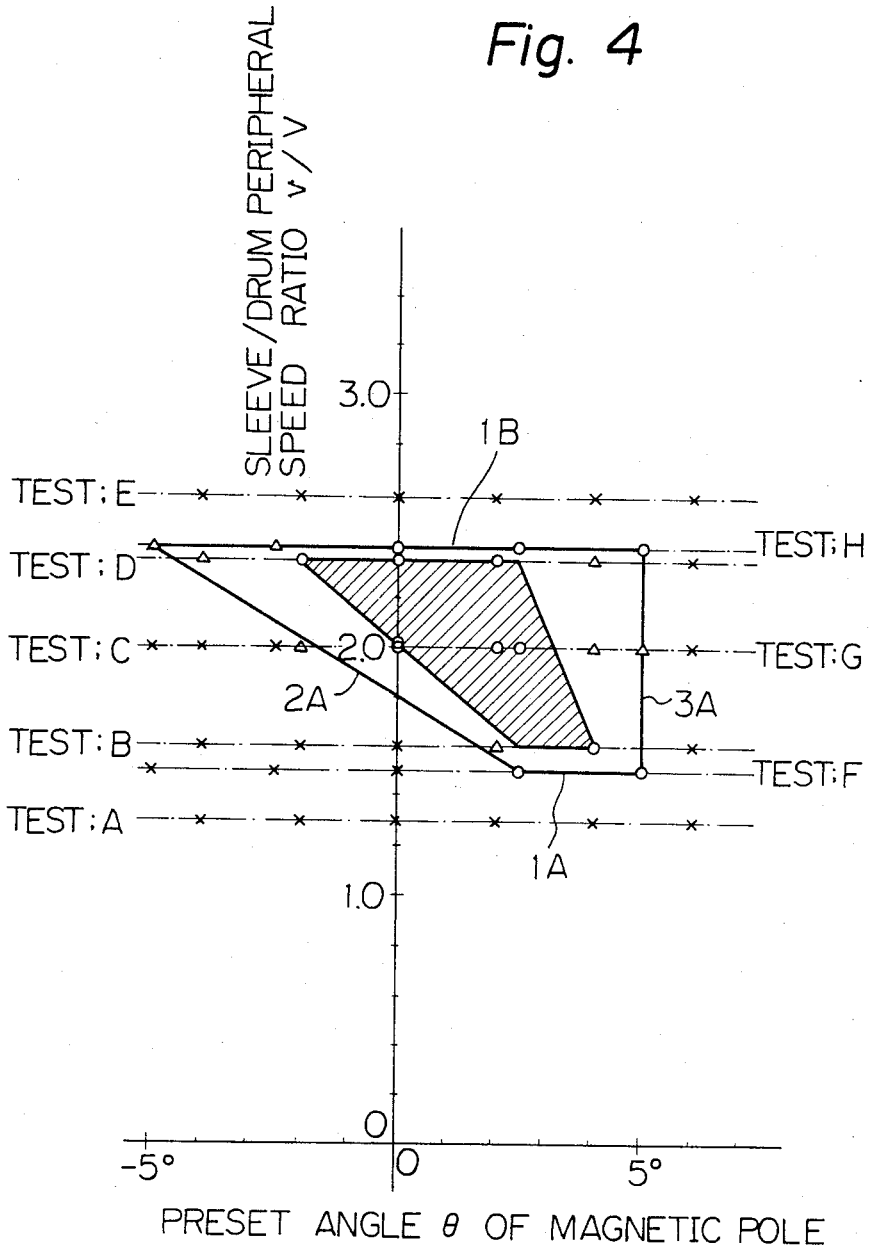
FIG. 4 is a diagram illustrating the relation between the peripheral speed ratio of a developing sleeve to a drum of a photosensitive material and a preset angle of a magnetic pole of a developing roll.

The development conditions adopted in this second preferred embodiment of the present invention are expressed by the region surrounded by lines 1A, 1B, 2A and 3A in FIG. 4. Lines 1A, 1B, 2A and 3A correspond to equations of $|v/V| = 1.5$, $|v/V| = 2.4$, $|v/V| = -0.12\theta + 1.8$ and $\theta = 5$, respectively.

In this embodiment, by reversing the moving directions of the drum and sleeve to each other at the position for the sliding contact with the magnetic brush, the photosensitive layer is uniformly brought into sliding contact with the magnetic brush and the contact frequency is increased. By deviating the magnetic pole in the downward direction of rotation of the drum with respect to the standard line M, the developing region of the sleeve or the developing time is expanded because the crest of the ear corresponds to the magnetic pole.

More specifically, in the region on the lower side of line 1A, the frequency of the sliding contact is reduced, resulting in extreme reduction of the image density, and edge effects are readily caused in the formed image. In the region on the upper side of line 1B, the frequency of the sliding contact becomes too high, and the gradation characteristic of the formed image is degraded and defects such as tailing are caused to appear. In the region on the left side of line 2A, the time for contact with the magnetic brush is shortened and hence, a sufficient amount of the toner is not attracted and the image density is reduced, and furthermore, brush marks or edge effects are readily produced. In the region on the right side of line 3A, the time for contact with the magnetic brush is too long, and hence, attraction of the toner becomes excessive and the gradation characteristic is readily degraded.

From the experimental results shown in Examples given hereinafter, it is seen that if the development conditions are slightly deviated from the region surrounded by the four lines in FIG. 4, the image quality is drastically degraded. Accordingly, it will readily be understood that the development region surrounded by the four lines in FIG. 4 is very critical for obtaining an image having a high quality.

From the development conditions shown in FIG. 4, it is seen that in the present preferred embodiment, in the range where the value of $|v/V|$ is small, the allowable range of the present angle of the magnetic pole is narrow, and as the value of $|v/V|$ is increased, the allowable range of the angle $\theta$ is broadened.

It is especially preferred that the values of $|v/V|$ and $\theta$ should satisfy the following requirements:

$$2.35 \geqq |v/V| \geqq 1.6 \quad (1'),$$

$$|v/V| \geqq -0.16\theta + 2.0 \quad (2')$$

and $$|v/V| \leqq -0.44\theta + 3.4 \quad (3')$$

Namely, it is especially preferred that the development be carried out under conditions included within the hatched region in FIG. 4.

In the present invention, a bias voltage is applied between the photosensitive material drum and the developing sleeve, and this bias voltage is determined so that sufficient charges are injected into the toner at the development but troubles such as discharge breakdown are not caused in the photosensitive material or magnetic brush. Ordinarily, it is preferred that the bias voltage be controlled to 100 to 300 volts, particularly 150 to 250 volts. Of course, the polarity of the bias voltage should be the same as the charge polarity of the photosensitive material. Namely, if the charge polarity of the photosensitive material is positive, the positive polarity is selected for the bias voltage. According to the present invention, by adopting the above-mentioned development conditions, the development can be performed at a relatively low bias voltage and the resistance of the photosensitive material to the printing operation can be improved.

In the magnetic development method of the present invention, the ear cutting of the magnetic brush is performed so that the surface of the magnetic material is sufficiently brought into sliding contact with the magnetic brush while the clearance between the photosensitive material drum and the developing sleeve is maintained at d. It is ordinarily preferred that the ear cutting of the magnetic brush be performed so that the ear length is 1.1 to 3.0 times, especially 1.2 to 2.0 times, the development clearance d. In the present invention, since a ferrite carrier having a small residual magnetization is employed, the ear of the magnetic brush can be shortened. This is another advantage attained by the present invention.

Known photosensitive materials for the electrophotography, such as a selenium-vacuum-deposited photosensitive material, an amorphous silicon photosensitive material, a CdS photosensitive material and an organic photoconductor photosensitive material, can be used in the present invention. Formation of an electrostatic latent image can easily be accomplished by known means, for example, the combination of charging and imagewise light exposure.

The present invention will now be described in detail with reference to the following examples that by no means limit the scope of the invention.

EXAMPLES 1 THROUGH 5

Developers having an electric resistance shown in Table 1 were prepared by mixing a ferrite carrier described below with a toner described below at an appropriate ratio and stirring the mixture. The development was carried out by using the so-prepared developers while changing the distance between the photosensitive material drum and developing sleeve as shown in Table 2. In each case, a clear image excellent in the gradation characteristic was obtained without formation of brush marks, fogging, transposition due to the edge effect, reduction of the image density or tailing.

(a) Ferrite Carrier:
Electric resistance: $2.6\times10^{9}-2.5\times10^{10}\Omega$
Maximum magnetization: 49.8 emu/g
Residual magnetization: 0.25 emu/g
Coercive force: 3.38 Oe
Median particle size: 40 microns (b) Toner:
Himer SBM-73 (styrene resin supplied by Sanyo Kasei Kogyo K.K.): 87 parts by weight
Viscol 55OP (low-molecular-weight polypropylene supplied by Sanyo Kasei Kogyo K.K.): 5 parts by weight
Special Black 4 (carbon black supplied by Degusa Co.): 5.5 parts by weight
Bontron S-32 (dye supplied by Orient Kagaku K.K.): 1.5 parts by weight A mixture comprising the foregoing ingredients was melted, kneaded and dispersed sufficiently by a hot three-roll mill, and the mixture was taken out from the mill, cooled, roughly pulverized to about 2 mm by a rough pulverizer (Rotoplex Cutting Mill supplied by Alpine Co.) and finely pulverized to about 10 to about 20 microns by an ultrasonic jet mill (supplied by Nippon Pneumatic Mfg. Co. Ltd.).

TABLE 1

| Developer | Electric Resistance (Ω) of Ferrite Carrier | Amount (g) of Ferrite Carrier | Amount (g) of Toner | Electric Resistance (Ω) of Developer |
|---|---|---|---|---|
| A | $2.6\times10^{9}$ | 900 | 100 | $2.00\times10^{8}$ |
| B | $6.9\times10^{9}$ | 900 | 100 | $7.14\times10^{8}$ |
| C | $1.4\times10^{10}$ | 900 | 100 | $1.18\times10^{9}$ |
| D | $2.5\times10^{10}$ | 920 | 80 | $2.22\times10^{9}$ |

TABLE 2

| Example No. | Developer | Distance (mm) between Photosensitive Material Drum and Developing Sleeve | Evaluation of Formed Image |
|---|---|---|---|
| 1 | A | 2.0 | fair |
| 2 | A | 1.7 | excellent |
| 3 | B | 1.0 | excellent |
| 4 | C | 1.0 | good |
| 5 | D | 1.0 | good |

COMPARATIVE EXAMPLES 1 THROUGH 8

By using the developers used in Examples 1 through 5 and a developer having a low electric resistance, which was prepared by mixing an iron powder carrier shown below with the same toner as used in Examples 1 through 5 at a weight ratio shown in Table 3, the copying operation was carried out in the same manner as described in Examples 1 through 5 while changing the distance between the photosensitive material drum and the developing sleeve as indicated in Table 4. Images having such defects as reduction of the gradation characteristic, formation of brush marks, fogging, transposition due to the edge effect, reduction of the image density and tailing, as indicated by marks "X" in Table 4, were obtained.

(c) Iron Powder Carrier:
Electric resistance: $4.0\times10^{6}$
Maximum magnetization: 180.0 emu/g
Residual magnetization: 15.0 emu/g
Coersive force: 17.30 Oe
Median particle size: 40 microns

TABLE 3

| Developer | Amount (g) of Iron Powder Carrier | Amount (g) of Toner | Electric Resistance (Ω) of Developer |
|---|---|---|---|
| E | 900 | 10 | $4.01\times10^{7}$ |

TABLE 4

| Comparative Example No. | Developer | Distance (mm) between Photosensitive Material Drum and Developing Sleeve | Reduction of Gradation Characteristic | Formation of Brush Marks | Fogging | Transposition | Reduction of Image Density | Tailing |
|---|---|---|---|---|---|---|---|---|
| 1 | E | 3.0 mm | X | X | | | | |
| 2 | A | 2.4 mm | | X | | | X | |
| 3 | E | 1.7 mm | X | X | X | | | X |
| 4 | B | 1.7 mm | | | | X | X | |
| 5 | C | 1.7 mm | | | | X | X | |
| 6 | D | 1.7 mm | | | | X | X | |
| 7 | A | 1.3 mm | X | | X | | | X |
| 8 | A | 1.0 mm | X | | X | | | X |

EXAMPLE 6

The above-mentioned ferrite carrier (a) was sufficiently mixed and stirred with the toner (b) at a weight ratio of 9/1 to form a developer having an electric resistance of $2.0\times10^{8}\Omega$ as measured according to the method for determining electric characteristics between the electrode drum and the developing sleeve.

The copying test was carried out by using the so-formed developer under the following conditions:
Radius R of Photosensitive Material Drum: 45.0 mm
Surface Voltage of Photosensitive Material: 750 volts
Radius r of Developing Sleeve: 19.0 mm
Bias Voltage: 250 volts
Ear Length δ of Developer: 1.0 mm The photosensitive material drum and the developing sleeve were rotated in the directions reverse to each other, and the rotation numbers of the drum and sleeve were adjusted as shown in Table 5. The preset angle of the magnetic pole closest to the photosensitive material drum in the downstream direction of rotation of the drum was changed as shown in Table 5. The results shown in Tables 6 through 13 were obtained in the region where the developing clearance d was from 1.5 mm to 1.9 mm. In these Tables, appearance of defects such as reduction of the gradation characteristic, fogging, transposition due to the edge effect, reduction of the image density, formation of brush marks and tailing are indicated by marks "X". Tables 6 through 13 show the influences of the preset angle of the magnetic pole to the quality of the image in Tests A through H shown in Table 5. Incidentally, in the column of "General Evaluation of Image" in each of Tables 6 through 13, mark "○" indicates "excellent", the mark "Δ" indicates "fair" and the mark "X" indicates "bad". The results of the general evaluation of the image quality are also shown in FIG. 4 by using the same marks.

TABLE 5

| Test | Photosensitive Material Drum | | Developing Sleeve | | |
|---|---|---|---|---|---|
| | Rotation Number (rpm) | Peripheral Speed V (cm/sec) | Rotation Number (rpm) | Peripheral Speed v (cm/sec) | Peripheral Speed Ratio v/V |
| A | 34.175 | 16.1 | 105.0 | 20.9 | 1.30 |
| B | " | " | 130.0 | 25.9 | 1.61 |
| C | " | " | 160.0 | 31.8 | 1.98 |
| D | " | " | 190.0 | 37.8 | 2.35 |
| E | " | " | 210.0 | 41.8 | 2.60 |
| F | 21.26 | 10.0 | 75.9 | 15.1 | 1.51 |
| G | " | " | 101.4 | 20.2 | 2.02 |
| H | " | " | 120.7 | 24.0 | 2.40 |

TABLE 6

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| A-1 | −4 | | | X | X | X | | X |
| A-2 | −2 | | | X | X | X | | X |
| A-3 | 0 | | | X | X | X | | X |
| A-4 | +2 | | | X | X | X | | X |
| A-5 | +4 | | X | X | X | X | | X |
| A-6 | +6 | | X | X | X | X | | X |

TABLE 7

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| B-1 | −4 | | | X | X | X | | X |
| B-2 | −2 | | | X | X | X | | X |
| B-3 | 0 | | | X | X | X | | X |
| B-4 | +2 | | | | | X | | Δ |
| B-5 | +4 | | | | | | | ○ |
| B-6 | +6 | X | X | | | | X | X |

TABLE 8

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| C-1 | −4 | | | X | X | X | | X |
| C-2 | −2 | | | X | | | | Δ |
| C-3 | 0 | | | | | | | ○ |
| C-4 | +2 | | | | | | | ○ |
| C-5 | +4 | | X | | | | | Δ |
| C-6 | +6 | X | X | | | | X | X |

TABLE 9

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| D-1 | −4 | | | X | | | | Δ |
| D-2 | −2 | | | | | | | ○ |
| D-3 | 0 | | | | | | | ○ |
| D-4 | +2 | | | | | | | ○ |
| D-5 | +4 | | X | | | | | Δ |
| D-6 | +6 | X | X | | | | X | X |

TABLE 10

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| E-1 | −4 | | X | X | X | X | | X |
| E-2 | −2 | X | X | | | | | X |

TABLE 10-continued

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| E-3 | 0 | X | X | | | | | X |
| E-4 | +2 | X | X | | | | | X |
| E-5 | +4 | X | X | | | | X | X |
| E-6 | +6 | X | X | | | | X | X |

TABLE 11

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| F-1 | −5 | | | X | X | X | | X |
| F-2 | −2.5 | | | X | X | X | | X |
| F-3 | 0 | | | X | X | | | X |
| F-4 | +2.5 | | | | | | | ○ |
| F-5 | +5 | | | | | | | ○ |

TABLE 12

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| G-1 | −5 | | | | X | X | | X |
| G-2 | −2.5 | | | X | X | | | X |
| G-3 | 0 | | | | | | | ○ |
| G-4 | +2.5 | | | | | | | ○ |
| G-5 | +5 | | | | | | X | Δ |

TABLE 13

| Test | Preset Angle (°) of Magnetic Pole | Reduction of Gradation Characteristic | Fog-ging | Transposi-tion Due to Edge Effect | Reduction of Image Density | Forma-tion of Brush Marks | Tailing | General Evalua-tion of Image |
|---|---|---|---|---|---|---|---|---|
| H-1 | −5 | | | X | | | | Δ |
| H-2 | −2.5 | | | X | | | | Δ |
| H-3 | 0 | | | | | | | ○ |
| H-4 | +2.5 | | | | | | | ○ |
| H-5 | +5 | | | | | | | ○ |

We claim:

1. A magnetic brush development method comprising supplying a two-component type developer comprising a mixture of magnetic carrier particles with toner particles chargeable by friction with the magnetic carrier particles onto a developing sleeve consisting of a non-magnetic sleeve having a magnet installed therein to form a magnetic brush of the developer, and bringing the magnetic brush in sliding contact with the surface of a photosensitive material having an electrostatic latent image formed thereon in the state where a bias voltage is applied between the photosensitive material and the sleeve, whereby a toner image corresponding to the electrostatic latent image is formed, wherein the two-component type developer comprises a ferrite carrier having a particle size of from about 20 to about 100 microns and electroscopic toner particles at a weight ratio of from 4/1 to 20/1 and wherein the development is carried out under conditions satisfying requirements represented by the following formulae:

$$5\times10^9 \geqq R \geqq 1\times10^8,$$

$$d \leqq (1.485\times10^5)/(\log R)^{5.3}$$

and $$d \leqq (1.485\times10^5)/(\log R)^{5.5}$$

wherein d stands for the clearance (mm) between the sleeve and the photosensitive material and R stands for the electric resistance (Ω) of the two-component type developer located between the sleeve and the photosensitive material, wherein the non-magnetic sleeve is moved at the position for the sliding contact with the developer in the direction opposite to the moving direction of a drum and the magnet in the sleeve is kept stationary during the development, and the development is carried out under conditions satisfying requirements represented by the following formulae:

$$2.4 \geqq |v/V| \geqq 1.5,$$

$$|v/V| \geqq -0.12\theta + 1.8$$

and $$\theta \leqq 5$$

wherein $\theta$ stands for the preset angle (degrees), in the downstream direction of rotation of the drum, of the magnetic pole closest to the standard line connecting the center of the drum to the center of the sleeve, V stands for the peripheral speed of the drum and v stands for the peripheral speed of the sleeve.

2. A magnetic brush development method according to claim 1 wherein the development is carried out under conditions such that the values of $|v/V|$ and $\theta$ satisfy the following requirements:

$$2.35 \geqq |v/V| \geqq 1.6 \quad (1')$$

$$|v/V| \geqq -0.16\theta + 2.0 \quad (2')$$

and $$|v/V| \leqq -0.44\theta + 3.4 \quad (3').$$

3. A magnetic brush development method according to claim 1 wherein the bias voltage applied between the photosensitive method and the sleeve is in the range of from 100 to 300 volts.

4. A magnetic brush development method according to claim 1 wherein the bias voltage applied between the photosensitive material and the sleeve is in the range of from 150 to 250 volts.

5. A magnetic brush development method according to claim 1 wherein the magnetic brush has an ear length of from 1.1 to 3.0 times the clearance d.

6. A magnetic brush development method according to claim 1 wherein the magnetic brush has an ear length of from 1.2 to 2.0 times the clearance d.

7. A magnetic brush development method according to claim 1 wherein the weight ratio of ferrite carrier particles to electroscopic toner particles is in the range of from 5/1 to 12/1.

8. A magnetic brush development method according to claim 1 wherein the ferrite carrier is comprised of sintered ferrite particles.

9. A magnetic brush development method according to claim 8 wherein the sintered ferrite particles comprise at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) or mixtures thereof.

10. A magnetic brush development method according to claim 8 wherein the sintered ferrite particles are comprised of manganese zinc iron oxide.

11. A magnetic brush development method according to claim 8 wherein the electroscopic toner particles are comprised of a granular composition comprising a coloring pigment and a charge controlling agent dispersed in a binder resin and having a particle size of 5 to 30 microns.

* * * * *

UNITED STATES PATENT AND TRADEMARK OFFICE

CERTIFICATE OF CORRECTION

PATENT NO. : 4,540,645

DATED : September 10, 1985

INVENTOR(S) : NOBUYASU HONDA, ET AL.

It is certified that error appears in the above-identified patent and that said Letters Patent is hereby corrected as shown below:

IN THE CLAIMS

Claim 1, line 23, (column 14, line 45), delete "≦", insert --≧--.

Claim 3, line 3, (column 15, line 22), delete "method", insert --material--.

Signed and Sealed this

*Twenty-sixth* Day of *November 1985*

[SEAL]

*Attest:*

DONALD J. QUIGG

*Attesting Officer*

*Commissioner of Patents and Trademarks*